US007299757B2

(12) United States Patent
Niizeki et al.

(10) Patent No.: US 7,299,757 B2
(45) Date of Patent: Nov. 27, 2007

(54) ZIGZAG SEWING MACHINE

(75) Inventors: Tomoyasu Niizeki, Nagoya (JP); Hiroshi Yamasaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/447,081

(22) Filed: Jun. 6, 2006

(65) Prior Publication Data

US 2006/0283365 A1 Dec. 21, 2006

(30) Foreign Application Priority Data

Jun. 15, 2005 (JP) ..... 2005-174940

(51) Int. Cl.
*D05B 27/08* (2006.01)
*D05B 3/04* (2006.01)

(52) U.S. Cl. ..... 112/323

(58) Field of Classification Search ..... 112/324, 112/323, 157, 448, 449, 459, 466, 314, 443
See application file for complete search history.

(56) References Cited

U.S. PATENT DOCUMENTS 3,026,832 A * 3/1962 Taketomi ..... 112/308
4,226,199 A * 10/1980 Adams ..... 112/308
4,691,654 A * 9/1987 Meier ..... 112/303
4,958,580 A * 9/1990 Asaba et al. ..... 112/314
5,063,867 A * 11/1991 Horie ..... 112/443
5,195,442 A * 3/1993 Meier ..... 112/475.19

FOREIGN PATENT DOCUMENTS

JP U 54-135263 9/1979

* cited by examiner

*Primary Examiner*—Ismael Izaguirre
(74) *Attorney, Agent, or Firm*—Oliff & Berridge, PLC

(57) ABSTRACT

A zigzag sewing machine including a needle bar having a sewing needle attached thereto, a needle swing mechanism that laterally swings the needle bar, a needle plate disposed on an upper surface of a sewing machine bed, and a feed dog constituted by a first to fourth teeth that feed a workpiece cloth by projecting/retracting from the needle plate. The zigzag sewing machine further includes a feed dog longitudinal transfer mechanism that longitudinally moves the feed dog, a feed dog lateral transfer mechanism that laterally moves the feed dog, and a control unit that controls the feed dog lateral transfer mechanism so that one of the teeth is associated with a needle drop point of the sewing needle.

12 Claims, 19 Drawing Sheets

| | NEEDLE DROP POINT POSITION (mm) | DISTANCE FROM FEED DOG LEFTMOST POSITION (mm) | BOBBIN THREAD CLAMPING TOOTH |
|---|---|---|---|
| (LEFT BASELINE POSITION) ··· | 0.0 | 0.0 | SECOND TOOTH |
| | 0.5 | 0.5 | SECOND TOOTH |
| | 1.0 | 1.0 | SECOND TOOTH |
| | 1.5 | 1.5 | SECOND TOOTH |
| | 2.0 | 1.6 | SECOND TOOTH |
| | 2.5 | 1.6 | SECOND TOOTH |
| | 3.0 | 1.6 | SECOND TOOTH |
| (MIDDLE BASELINE POSITION) ··· | 3.5 | 0.0 | – |
| | 4.0 | 0.0 | THIRD TOOTH |
| | 4.5 | 0.0 | THIRD TOOTH |
| | 5.0 | 0.0 | THIRD TOOTH |
| | 5.5 | 0.5 | THIRD TOOTH |
| | 6.0 | 1.0 | THIRD TOOTH |
| | 6.5 | 1.5 | THIRD TOOTH |
| (RIGHT BASELINE POSITION) ··· | 7.0 | 1.6 | THIRD TOOTH |

FIG.15

ZIGZAG SEWING MACHINE

CROSS-REFERENCE TO RELATED APPLICATIONS

This application is based upon and claims the benefit of priority from the prior Japanese Patent Application 2005-174940, filed on, Jun. 15, 2005 the entire contents of which are incorporated herein by reference.

TECHNICAL FIELD

The present disclosure relates to a zigzag sewing machine including a needle swing mechanism that swings a needle bar, a cloth feed mechanism moving a feed dog in vertical and longitudinal directions, and a feed dog lateral transfer mechanism moving the feed dog in the lateral direction.

BACKGROUND

A conventional zigzag sewing machine has an arm including a needle bar drive mechanism that vertically moves a needle bar having a sewing needle attached thereto and a needle swing mechanism that swings the needle bar; and a sewing machine bed including a needle plate and a feed dog that projects/retracts from the needle plate in order to move a workpiece cloth.

The feed dog is generally provided with a plurality of longitudinally extending teeth, and is fed in a four-step cycle by a cloth feed mechanism provided inside the sewing machine bed. Formed on the needle plate disposed on the sewing machine bed upper surface is a needle hole extending laterally so as to correspond to the lateral swing of the sewing needle; and a plurality of longitudinally extending square holes for projecting/retracting a plurality of teeth therethrough.

The zigzag sewing machine of the aforementioned type moves the feed dog in plurality directions to provide for sewing complex sewing patterns. For example, JP-Y1-S54-135263 discloses a cloth feed dog having four rows of teeth which not only perform four-step feed, but also move in the lateral direction as well. Under such construction, the widths of the four rows of square holes are widened, allowing the teeth to move in the lateral direction. Thus, the workpiece cloth is moved by the teeth in both longitudinal and lateral directions, as well as in the oblique direction which is a combination of the aforementioned two directions.

However, under such construction, there is an increased possibility of defective stitches being formed upon forming straight stitches on the workpiece cloth. That is, since the widths of the square holes are widely arranged with respect to the four rows of teeth, depending upon the position of the needle drop point, the cloth presser and the teeth fail to clamp the straight stitches formed on the workpiece cloth. Hence, there are increased instances where cloth feed is carried out with a stitchless portion of the workpiece cloth being fed by being clamped between the cloth presser and the teeth. At this time, since tension is applied on a needle thread by cloth-feed, seam puckering is observed on the stitches of the workpiece cloth, forming defective seams in which the stitches are drawn up. Defective seams become more prominent especially upon sewing a thin workpiece cloth, or sewing with thicker sewing thread or with increased sewing speed. Reducing the thread tension of the thread tension regulator is a possible solution to the above problem. However, in such case, repetitive trial sewing needs to be performed in order to obtain the suitable thread tension for various types of workpiece cloth, sewing thread and sewing speed. This calls for a complex and time consuming preparatory work, which does not satisfy practical use.

SUMMARY

Therefore, an object of the present disclosure is to provide a zigzag sewing machine capable of clamping a stitch formed on a workpiece cloth by one of the teeth formed on the feed dog and a cloth presser in order to prevent the formation of defective seams and seam puckering to the possible extent.

The zigzag sewing machine of the present disclosure is characterized in including a needle bar having a sewing needle attached thereto, a needle swing mechanism that laterally swings the needle bar, a needle plate disposed on the upper surface of a sewing machine bed, and a feed dog constituted by a plurality of teeth that feed a workpiece cloth by projecting/retracting from the needle plate. The zigzag sewing machine further includes a feed dog longitudinal transfer mechanism longitudinally moving the feed dog, a feed dog lateral transfer mechanism that laterally moves the feed dog, and a control unit that controls the feed dog lateral transfer mechanism so that one of the teeth is associated with a needle drop point of the sewing needle.

One of the teeth can be moved to a position corresponding to the needle drop point of the sewing needle by the control unit. Thus, since the stitch formed on the workpiece cloth can be clamped by one of the feed dog teeth and the cloth presser, no seam puckering occurs even if tension is applied to the needle thread by cloth feed. Thus, defective seams can be prevented to the possible extent without thread tension regulation.

BRIEF DESCRIPTION OF THE DRAWINGS

Other objects, features and advantages of the present disclosure will become clear upon reviewing the following description of the illustrative aspects with reference to the accompanying drawings, in which.

FIG. 15 shows settings of a needle drop point position/feed dog position mapping table;

Figure 1:
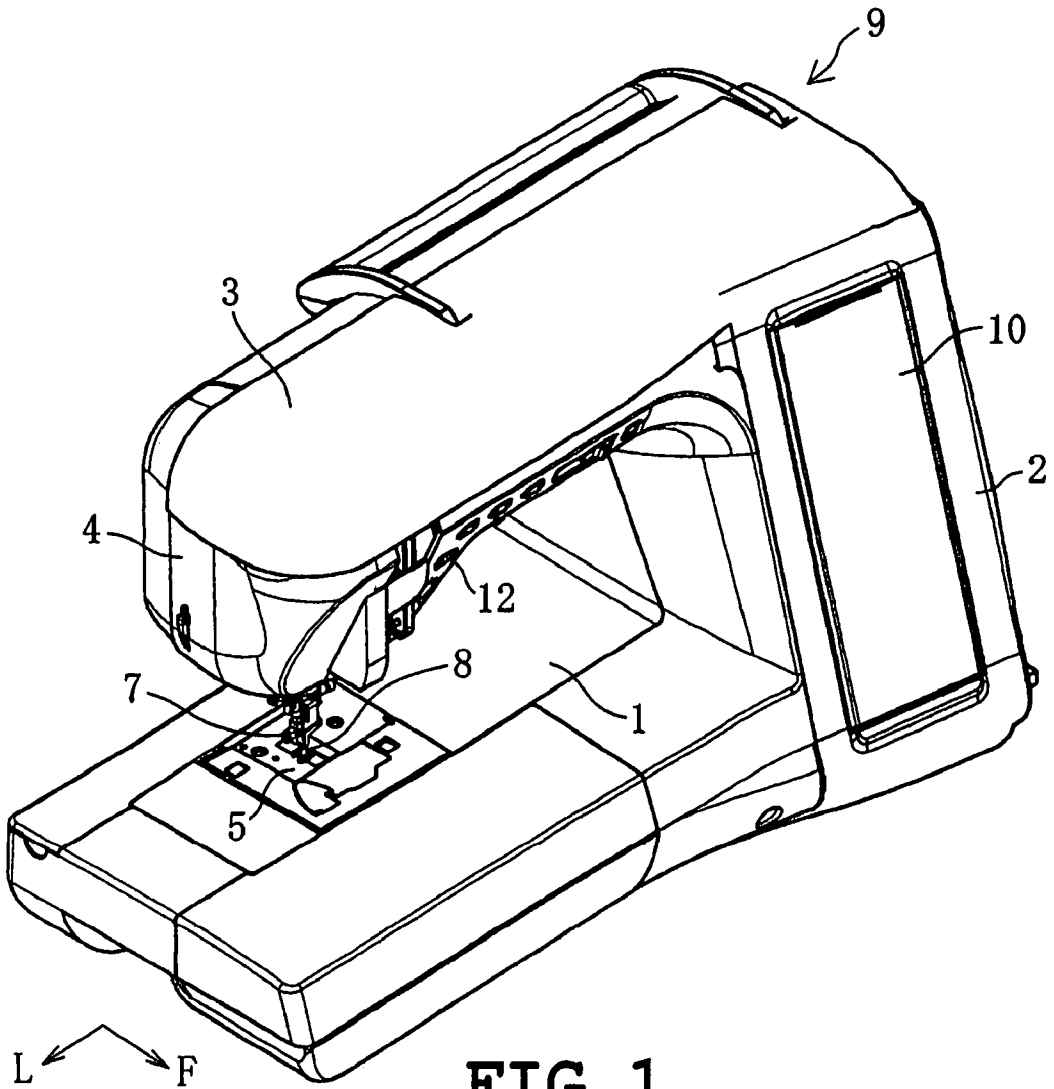
FIG. 1 is a perspective view depicting one illustrative aspect of the present disclosure, indicating an external appearance of a zigzag sewing machine.

At least one of a plurality of embodiments according to the present invention will be described hereinafter with reference to FIGS. 1 to 22. For the purpose of describing the present invention, the arrow F illustrated in the drawings such as FIGS. 1 and 5 indicate the front direction.

DETAILED DESCRIPTION OF THE PREFERRED EMBODIMENT

The electronic zigzag sewing machine 9, as shown in FIG. 1, is a general household-electronic sewing machine and is provided integrally with a bed 1, a foot 2 extending upright from the right end of the bed 1, and an arm 3 extending leftward in a protruding manner from the upper portion of the foot 2.

A laterally extending sewing machine main shaft (not shown) and a sewing machine motor 78 (refer to FIG. 14) that rotate the sewing machine main shaft are provided in the arm 3. Also a hand pulley (not shown) that rotates the sewing machine main shaft and is capable of being manually operated externally is provided in the arm 3.

A needle bar 8 having a sewing needle 7 in the lower end thereof is provided in the head 4 which is formed in the left portion of the arm 3. The needle bar 8 is vertically moved by the rotation of the sewing machine main shaft via a needle bar drive mechanism (not shown). Provided in the arm 3 is a thread take-up drive mechanism (not shown) that vertically moves the thread take-up (not shown) in synchronization with the vertical transfer of the needle bar 8, and the like. Various switches such as a start/stop switch 12 that instructs the start and stop of a sewing operation are provided on the front side of the arm 3.

On the other hand, an oblong needle plate 5 is mounted on the upper surface of the bed 1 by a fixing screw 5*f* (refer to FIG. 12C) so as to confront the head 4 of the arm 3. As will be described in detail thereinafter, defined in the needle plate 5 is a needle hole 5*e* through which the sewing needle 7 penetrates and a plurality of square holes 5*a* to 5*d* that allows the transfer of the feed dog 6. A cloth feed mechanism 26 and a feed dog lateral transfer mechanism 50 that move the feed dog 6 in the longitudinal and lateral directions are provided inside the bed 1. Also, though not shown, provided in the bed 1 is a cloth presser device comprising a cloth presser, a thread cutting mechanism, a horizontal rotary hook supplying lower thread and executing a sewing operation in cooperation with the sewing needle 7, and the like.

A vertically oriented liquid crystal display 10 is provided on the front surface of the foot 2. Plurality types of utility stitches for linear sewing and zigzag sewing, for example, are displayed in the liquid crystal display 10 upon pattern selection. Also, function names that represent various functions required in a sewing operation and various guidance messages and other items are displayed in the liquid crystal display 10.

A transparent touch panel 11 (refer to FIG. 14) provided with multiple touch keys is provided on the front surface of the liquid crystal display 10. The touch keys correspond to different types of stitches and function names displayed in the liquid crystal display 10. In other words, pattern selection can be carried out by pressing the touch key corresponding to the desired stitch and a desired function can be executed by pressing the corresponding touch key.

Provided in the arm 3 is a needle swing mechanism 15 that swings the needle bar in the lateral direction perpendicular to the cloth feed direction of the needle bar 8. The structure of the needle swing mechanism 15 will be described herein after.

Figure 2:
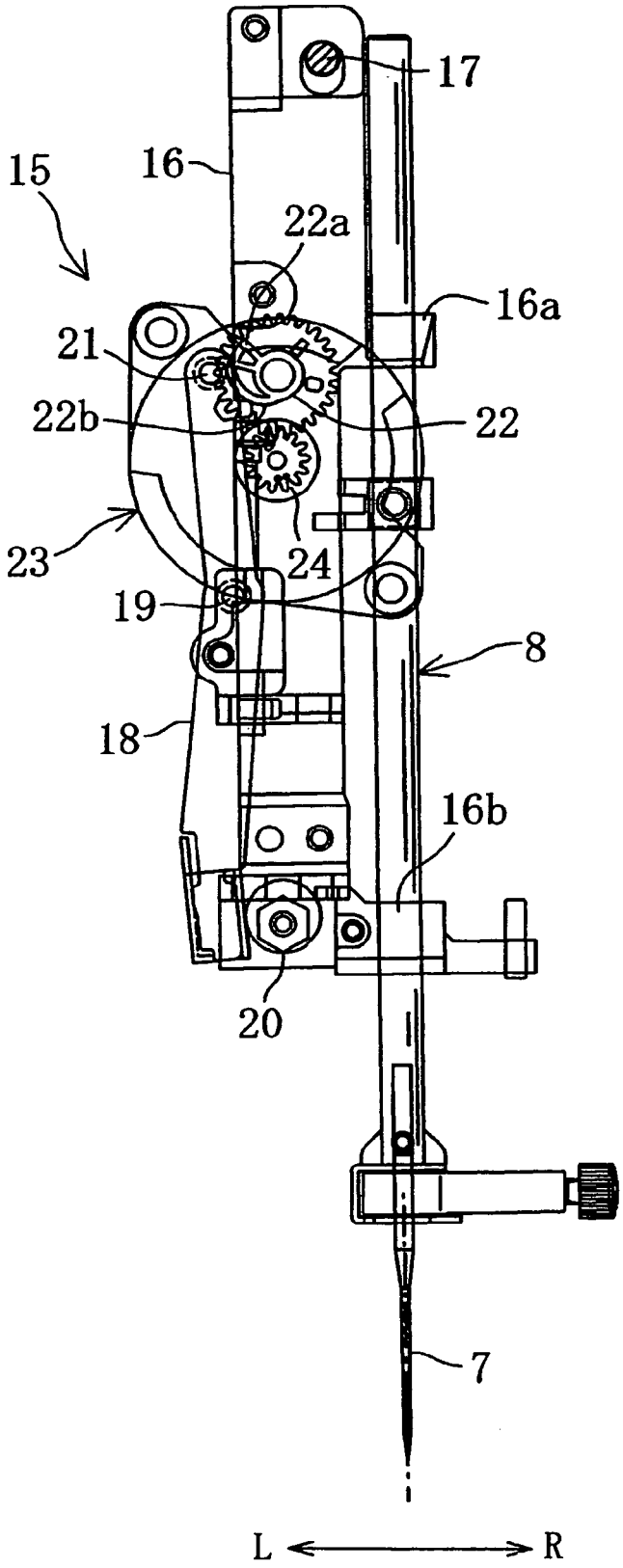
FIG. 2 is a front view of a needle swing mechanism portion.

As shown in FIG. 2, the needle swing mechanism 15 has a vertically extending needle bar base 16. The needle bar base 16 has a cam body 20 fixed on the lower end thereof, and is swingably supported by the sewing machine frame (refer to FIGS. 3 and 4) by a pivot shaft 17 on the upper end thereof. An upper pivotal portion 16*a* and a lower pivotal portion 16*b* are provided on the needle bar base 16 respectively by which the needle bar 8 is supported vertically movably. Thus, the needle bar 8 is laterally swung along with the needle bar base 16 and is swung vertically with respect to the needle bar base 16.

A vertically extending swing lever 18 is disposed in the left side of the needle bar base 16. The substantial center of the swing lever 18, which is disposed in the left side of the substantial center of the needle bar base 16, is rotatably supported by the machine frame 14 via a pivot pin 19. The lower end of the swing lever 18 abuts the cam body 20. Also, a longitudinally extending abutting pin 21 is fixed on the upper end of the swing lever 18.

A swing cam 22 abutting the abutting pin 21 is pivoted on the sewing machine frame 14. Formed on the swing cam 22 is a large-radius cam portion 22*a* disposed away from the rotational shaft center and a small-radius cam portion 22*b* disposed close to the rotational shaft center of the swing cam 22. The large- and small-radius cam portions 22*a* and 22*b* form a smooth and continuous curved cam-surface on the swing cam 22. On the other hand, the lower end of the needle bar base 16 is leftwardly (clockwise direction in FIG. 2) biased by a coil spring not shown and the lower end of the swing lever 18 is thereby pressed against the cam body 20 of the needle bar base 16. Thus, the swing lever 18 is rotated in the clockwise direction about the pivot pin 19 and the abutting pin 21 abuts the cam surface.

A gear is formed on the outer periphery of the swing cam 22. A drive gear 24 in mesh engagement with the gear is attached to the drive shaft of a needle swing motor 23 mounted on the sewing machine frame 14. Thus, the rotation of the needle swing motor 23 is conveyed to the gear via the drive gear 24, consequently rotating the swing cam 22 in the clockwise or the counterclockwise direction.

Figure 3:
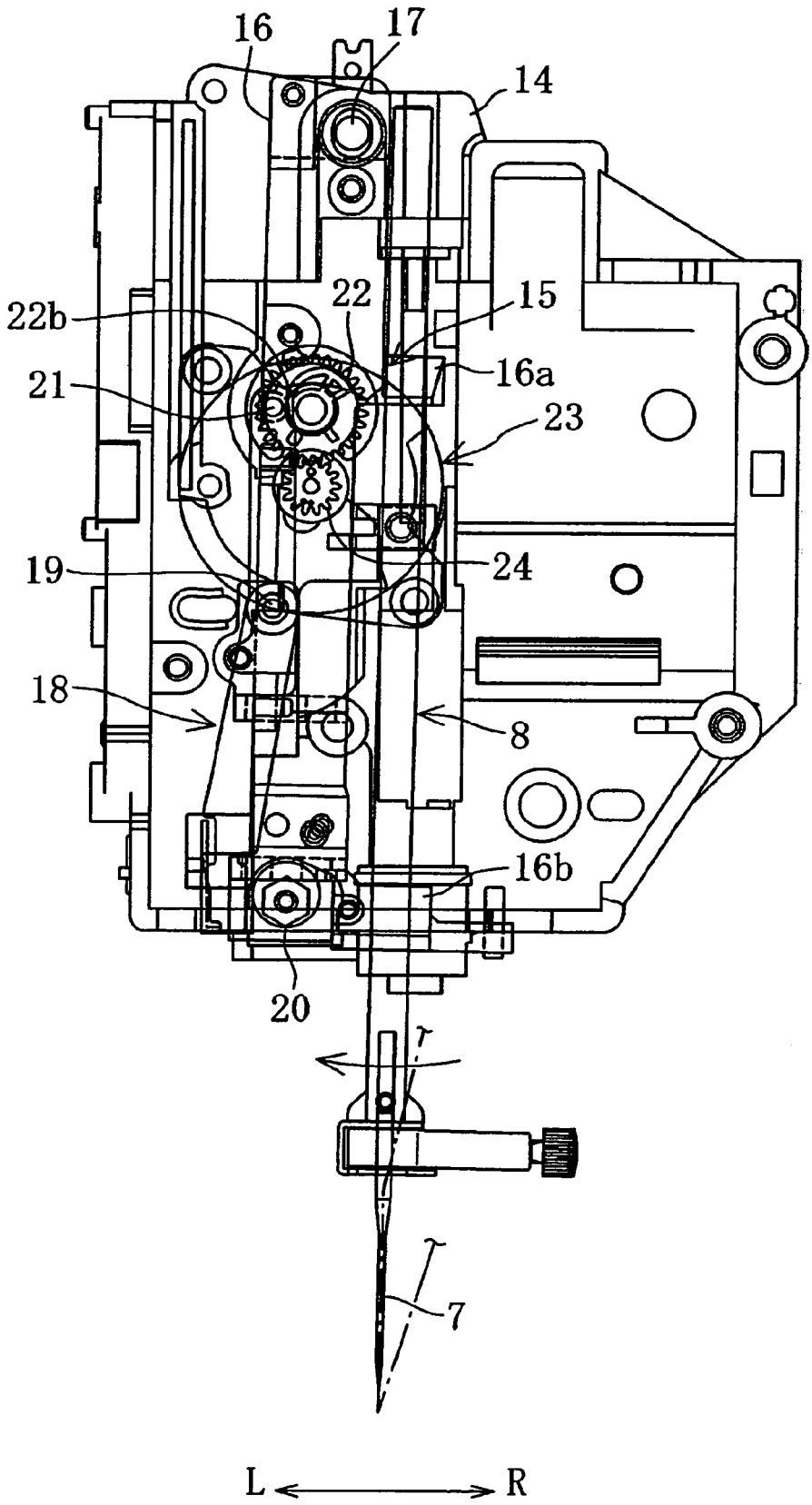
FIG. 3 is a front view of the needle swing portion in which a sewing needle is in a left baseline position shown with a sewing machine frame.

As shown in FIG. 3, when the swing cam 22 is rotated clockwise, the abutting pin 21 and the small-radius cam portion 22*b* of the cam surface are placed in abutment. In such case, the upper end of the swing lever 18 is rightwardly moved while the lower end thereof is leftwardly moved. Hence, the needle bar base 16 and the needle bar 8 are moved to a swing position in the left side. A left baseline position 7*a* (refer to FIG. 19) is a needle drop point, on which the sewing needle 7 is dropped on the workpiece cloth, when the needle bar base 16 and the needle bar 8 assume the left swing position. The left baseline position 7*a* is also set as the basic needle drop point position.

Figure 4:
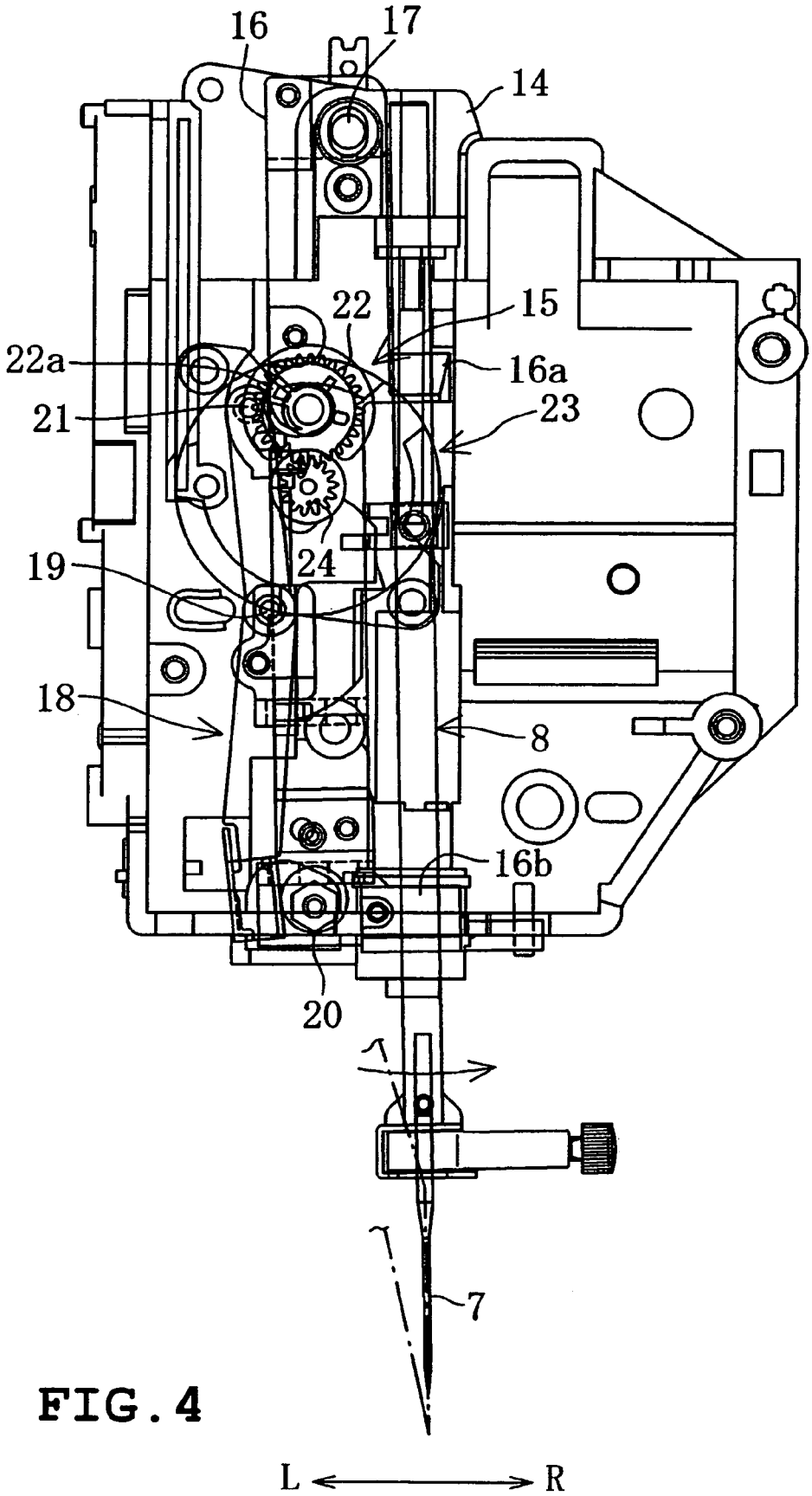
FIG. 4 corresponds to FIG. 3 in which the sewing needle is in a right baseline position.

On the other hand, as shown in FIG. 4, when the swing cam 22 is rotated counterclockwise, the abutting pin 21 and the large-radius cam portion 22*a* of the cam surface are placed in abutment. In such case, the upper end of the swing lever 18 is moved to the left while the lower end thereof is moved to the right. Hence, the needle bar base 16 and the needle bar 8 are moved to a swing position in the right side. A right baseline position 7*b* (refer to FIG. 22) is a needle drop point, on which the sewing needle 7 is dropped on the workpiece cloth, when the needle bar base 16 and the needle bar 8 assume the right swing position.

Also, the needle swing width of the sewing needle 7 ranging from the left baseline position 7*a* to the right baseline position 7*b* is set at approximately 7 mm. The intermediate position between the left baseline position 7*a* and the right baseline position 7*b* is defined as the middle baseline position 7*c* (refer to FIGS. 19 and 22). That is, the swing width of the sewing needle 7 moved from the left baseline position 7*a* to the middle baseline position 7*c* is approximately 3.5 mm and the swing width from the middle baseline position 7*c* to the right baseline position 7*b* is approximately 3.5 mm.

Figure 12A:
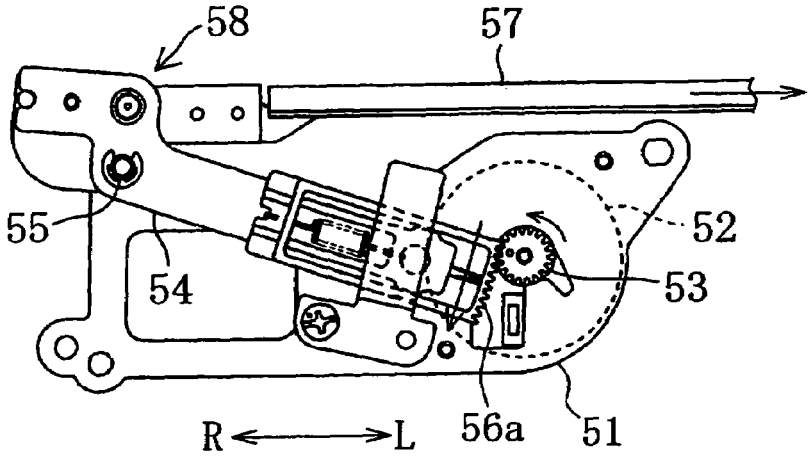
FIG. 12A corresponds to FIG. 11 with the feed dog in a leftmost position.
Figure 12B:
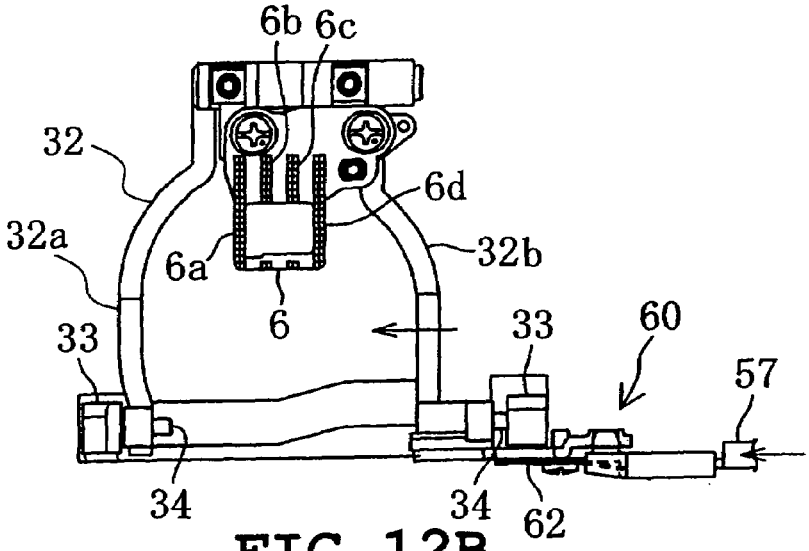
FIG. 12B is a plan view of the feed base with the feed dog in the leftmost position.
Figure 12C:
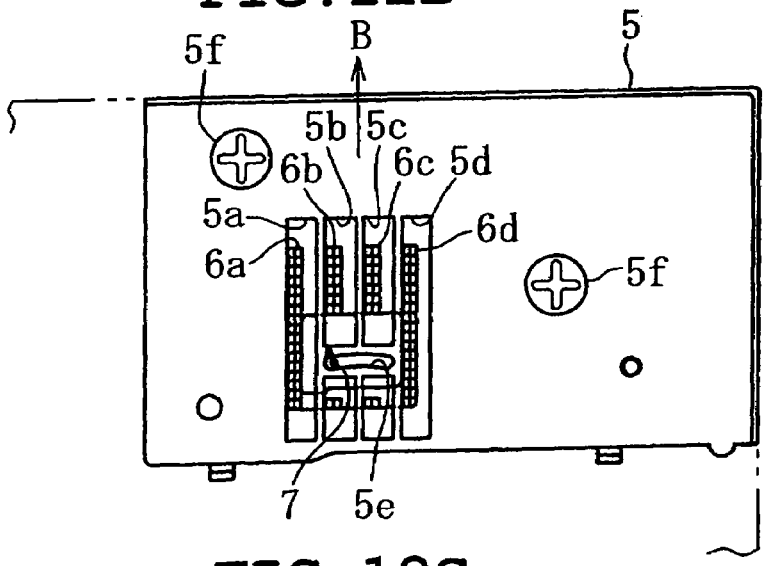
FIG. 12C is a plan view of a needle plate portion with the feed dog in the leftmost position.

Thus, since the sewing needle 7 is laterally moved, the needle hole 5*e* provided in the needle plate 5 is in a laterally extending form (refer to FIG. 12C). The needle hole 5*e* takes on a slightly curved form and the lateral width thereof is arranged to be longer than the aforementioned needle swing width of approximately 7 mm.

Also, longitudinally extending square holes 5*a* to 5*d* are formed in the needle plate 5. A plurality of first to fourth teeth 6*a* to 6*d* formed on the feed dog 6 project/retract from the square holes 5*a* to 5*d*. More specifically, the feed dog 6 comprises a second and third teeth 6*b* and 6*c* provided in the cloth feed direction side of the needle hole 5*e* (direction of arrow B in FIG. 12C). The feed dog 6 further comprises a pair of a first and fourth teeth 6*a* and 6*d* which extends in the cloth feed direction and which is disposed in the left and right sides of the second and third teeth 6*b* and 6*c* and the needle hole.

The lateral widths of the square holes 5*a* to 5*d* are set at approximately 3.0 mm. The longitudinal lengths of the square holes 5*a* to 5*d* are set at such length that ensures the longitudinal transfer of the first to fourth teeth 6*a* to 6*d*.

Figure 5:
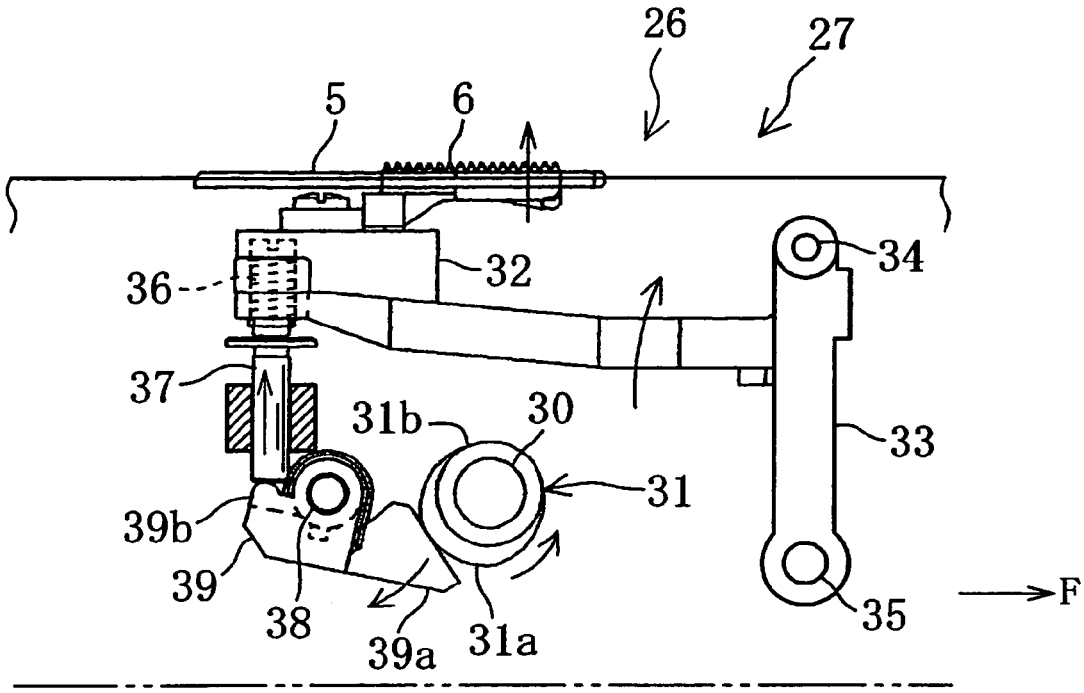
FIG. 5 is a left side view of a feed dog vertical transfer mechanism in a cloth feed position.
Figure 6:
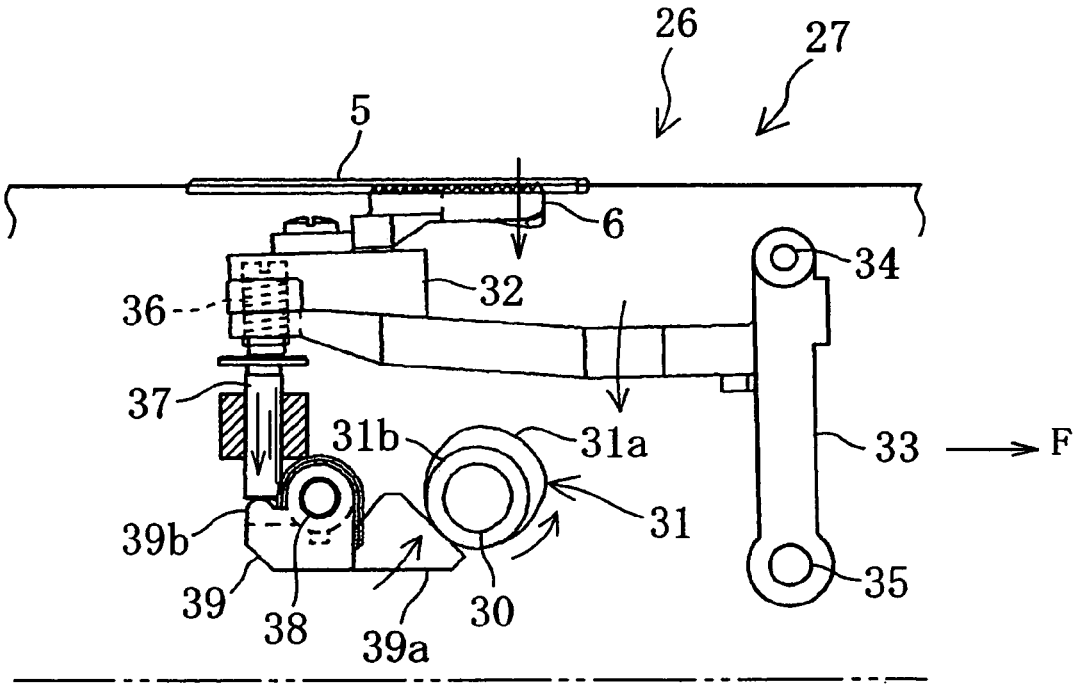
FIG. 6 corresponds to FIG. 5 in a lowered position.

Next, a feed dog mechanism 26 and a feed dog longitudinal transfer mechanism 28 will be described herein after. The feed dog mechanism 26 includes a feed dog vertical transfer mechanism 27 that vertically moves the feed dog 6. The feed dog longitudinal transfer mechanism 28, on the other hand, longitudinally moves the feed dog 6. First, a description will be given on the feed dog vertical transfer mechanism 27. As shown in FIGS. 5 and 6, a feed dog base 32 is provided inside the bed 1 below the needle plate 5. The feed dog 6 is fixed on the upper surface of the feed base 32 rear portion. A pair of legs 32*a* and 32*b* in a bifurcated profile having a laterally opened front side is formed (refer to FIGS. 9 and 12B) in the front portion of the feed base 32. The upper ends of a pair of vertically extending longitudinal swing levers 33 are rotatably pivoted to the front end of the legs 32*a* and 32*b* by a pivot pin 3. The lower end of the pair of swing levers 33 is rotatably pivoted to the frame not shown by a pivot pin 35.

On the other hand, a height adjustment bolt 36 is provided in the rear end of the feed base 32. The lower end of the height adjustment bolt 36 abuts the upper end of a vertically moving pin 37 extending in the vertical direction. The vertically moving pin 37 is provided vertically movably on the frame and is vertically moved by a vertical feed cam 31 and a vertical feed contact 39.

That is, a vertical feed cam 31 provided integrally with an eccentric cam 31*a* and a concentric cam 31*b* is disposed in front of the lower end of the vertically moving pin 37. The vertical feed cam 31 is fixed on a rotatable lower shaft 30 extending in the lateral direction, and the concentric cam 31*b* is disposed concentric with respect to the lower shaft 30. On the other hand, the eccentric cam 31*a* is provided eccentric with respect to the lower shaft 30 so that a part of the eccentric cam 31*a* surface becomes coplanar with a part the concentric cam 31*b* surface. The lower shaft 30 is connected to the sewing machine main shaft and is rotated integrally with the vertical feed cam 31 when the rotation of the main shaft is transmitted thereto.

The vertical feed contact 39 is disposed between the lower end of the vertically moving pin 37 and the lower shaft 30. The upper portion of the vertical feed contact 39 is rotatably supported by a cam shaft 38 provided in parallel with the lower shaft 30. A cam contact 39*a* that selectively contacts the eccentric cam 31*a* and the concentric cam 31*b* are formed in the right portion of the vertical feed contact 39. The vertical feed contact 39 is biased by a compression coil spring not shown so that the cam contact 39*a* is in consistent contact with the eccentric cam 31*a*.

An upwardly oriented abutting portion 39*b* that abuts the lower end of the vertically moving pin 37 is formed on the left portion of the vertical feed contact 39. The rear end of the feed base 32 is consistently biased downward by a helical extension spring not shown. Hence, the abutment between the height adjustment bolt 36 and the vertically moving pin 37, and between the vertically moving pin 37 and the abutting portion 39*b* are maintained consistently.

Thus, a circular motion of the eccentric cam 31*a* is conveyed to the rear end of the feed base 32 via the vertical feed contact 39, vertically moving pin 37 and the height adjustment bolt 36. Hence, the feed dog 6 is moved vertically between a feeding position shown in FIG. 5, and a lowered position shown in FIG. 6.

Figure 7:
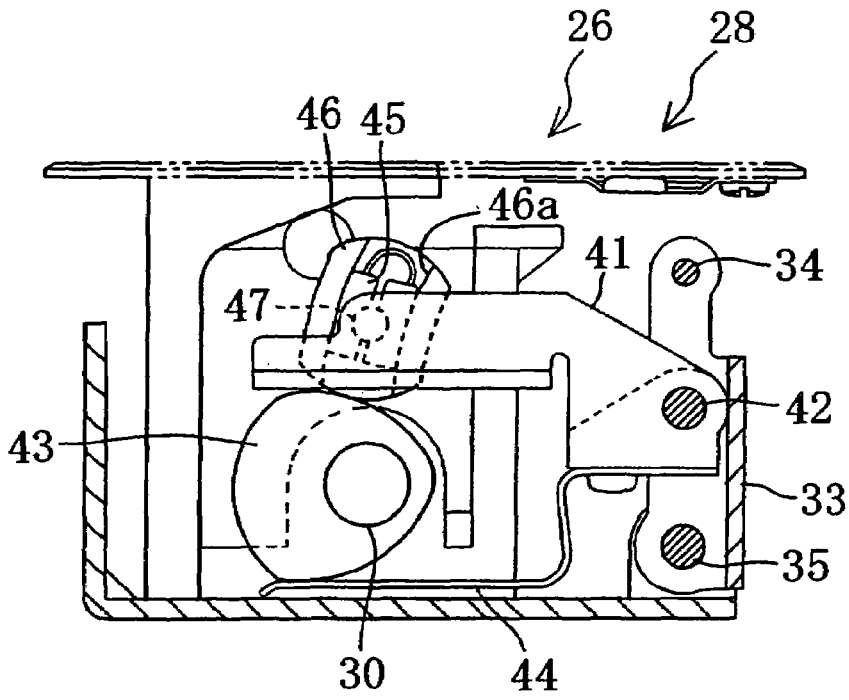
FIG. 7 is a left side view of a feed dog longitudinal transfer mechanism.

Next, a description will be given on the feed dog longitudinal transfer mechanism 28. As shown in FIG. 7, a longitudinal feed cam 43 is fixed eccentrically with respect to the lower shaft 30. A swing link 41 extending in the longitudinal direction is disposed on the upper side of the longitudinal feed cam 43. The base end of the swing link 41 is rotatably supported by a laterally extending support shaft 42 provided in the substantial center of the right side longitudinal swing lever 33. A rearwardly extending spring plate member 44 is provided on the base end of the swing link 41. The rear portion of the spring plate member 44 is disposed below the longitudinal feed cam 43 and is biased so as not to create any space between the swing link 41 and the longitudinal feed cam 43. A sliding block 45 is rotatably supported on the distal end of the swing link 41.

On the other hand, a feed regulator 46 made of metal is provided in the upper portion of the swing link 41. The feed regulator 46 is rotatably supported by a rightwardly extending shaft member 47 provided on the frame not shown. A guide groove 46*a* forwardly inclined with respect to the vertical direction is formed on the left side surface of the feed regulator 46. The sliding block 45 is slidably engaged with the guide groove 46*a* so as to be guided by the guide groove 46*a*. Thus, the circular motion of the longitudinal feed cam 43 is conveyed to the swing link 41 and the distal end of the wing link 41 in a reciprocating manner in the guiding direction of the sliding block 45. Consequently, the longitudinal swing lever 33 is swung longitudinally about the pivot pin 35. The feed base 32 and the feed dog 6 are swung longitudinally by the above described swing movement, thus rearwardly feeding the sewing object, that is, the workpiece cloth.

Figure 8:
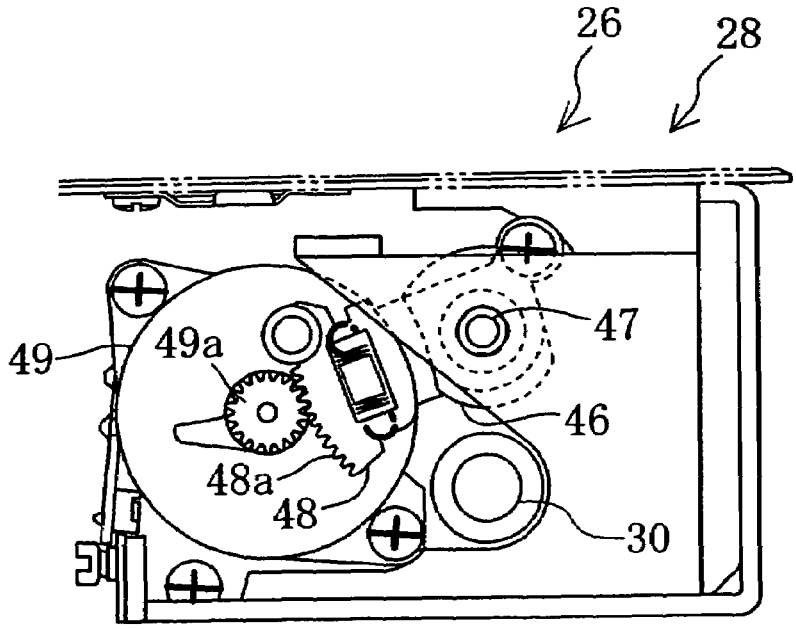
FIG. 8 is a right side view of a feed dog longitudinal transfer mechanism.
Figure 9:
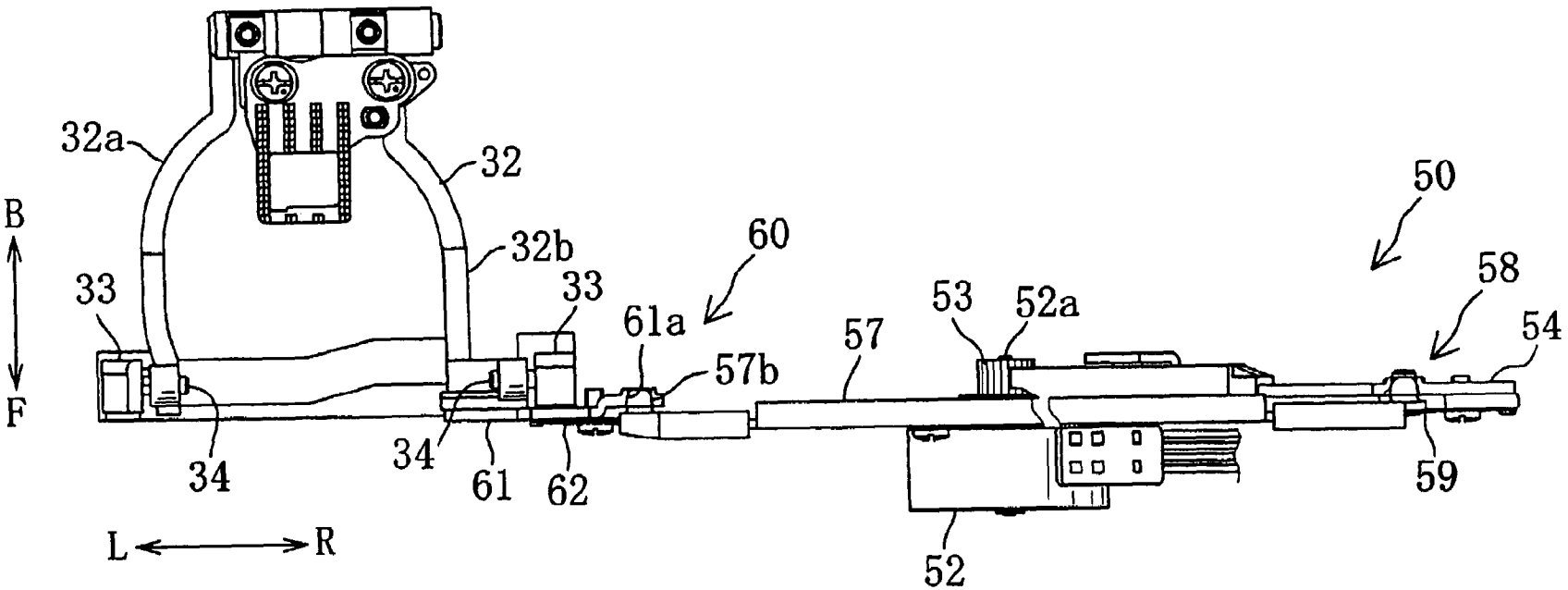
FIG. 9 is a plan view of a feed dog lateral transfer mechanism shown with a feed base.

Also, the feed dog longitudinal transfer mechanism 28 is capable of regulating the longitudinal feed amount of the feed dog 6. That is, as shown in FIG. 8, a sector gear 48 made of a metal plate is fixed on the right end surface of the feed regulator 46. A gear 48*a* in a circumferential shape is formed on the distal end of the sector gear 48. On the other hand, a sidewardly oriented longitudinal transfer motor 49 is fixed on the frame not shown. A pinion gear 49*a* in mesh engagement with the gear 48*a* is mounted on a drive shaft of the motor 49. Consequently, the rotation of the longitudinal transfer motor 49 is conveyed to the sector gear 48 via the pinion gear 49*a*, and the feed regulator 46 is rotated about a shaft member 47, changing the inclination of the guide groove 46*a*. Thus, the longitudinal feed amount of the feed dog 6 is controlled by changing the guiding direction of the sliding block 45 and by regulating the amount of longitudinal movement of the swing link 41 and the longitudinal swing lever 33.

Figure 10:
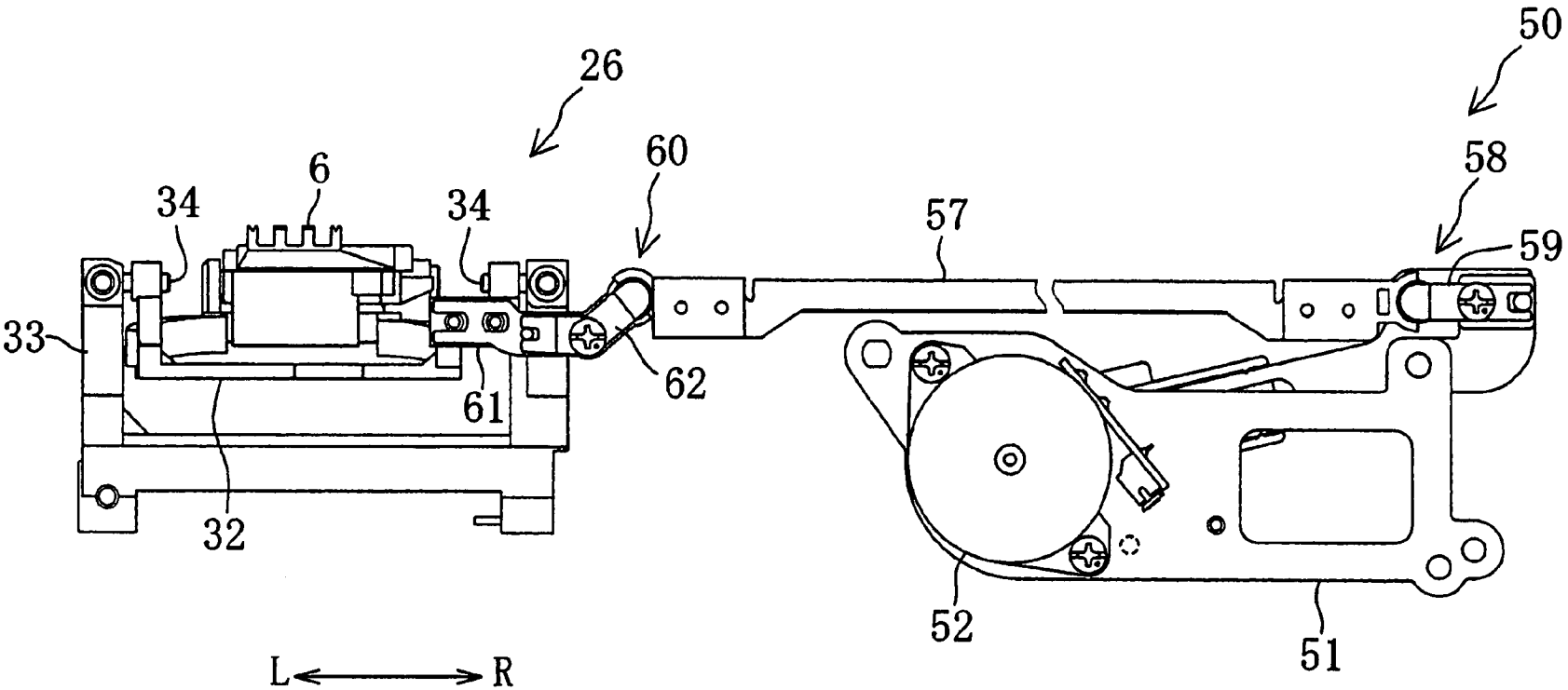
FIG. 10 is a is a front view of the feed dog lateral transfer mechanism shown with a feed base.

Next, the feed dog lateral transfer mechanism 50 that laterally moves the feed dog 6 will be described hereinafter. As shown in FIG. 10, a frame 51 extending in the vertical and lateral directions is fixed on the sewing machine frame 14 (refer to FIGS. 3 and 4) in the right side of the feed base 32. A lateral transfer motor 52 composed of a stepping motor is fixed in the front side of the frame 51 as shown in the drawings such as FIGS. 9 and 11. A drive shaft 52*a* of the lateral transfer motor 52 penetrates the frame 51 and protrudes to the rear side thereof. A drive gear 53 is mounted on the distal end of the drive shaft 52*a*.

Figure 11:
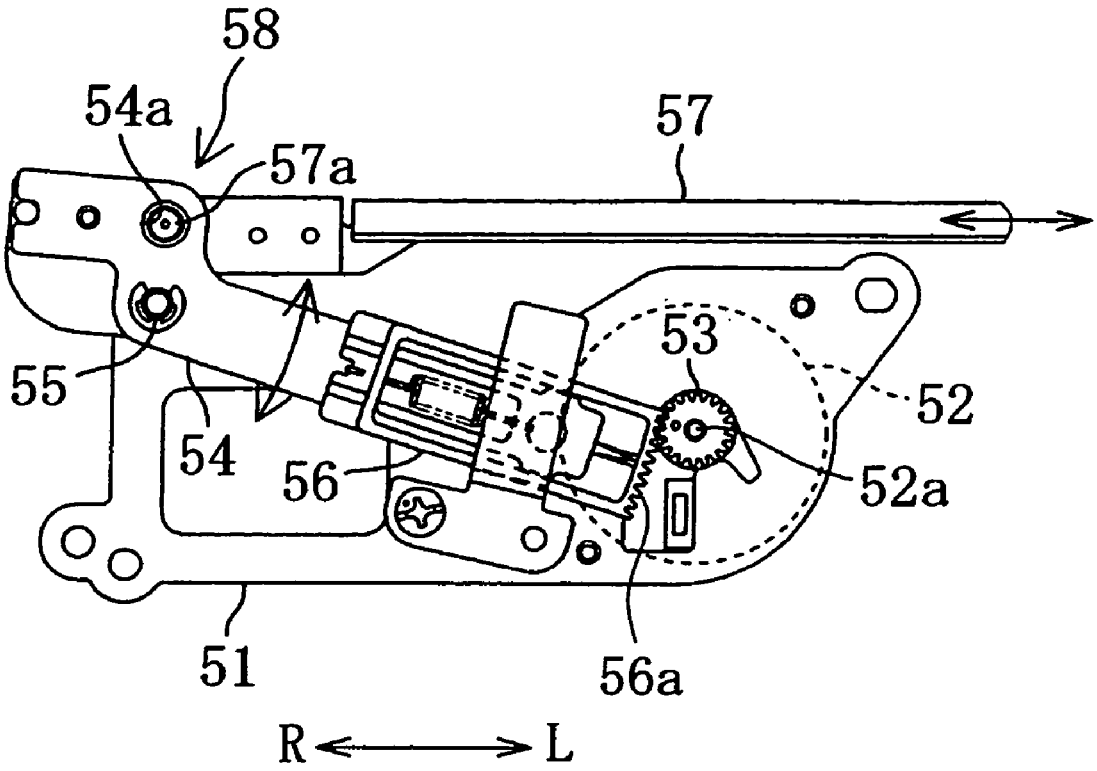
FIG. 11 is a rear view of the feed dog lateral transfer mechanism.
Figure 13A:
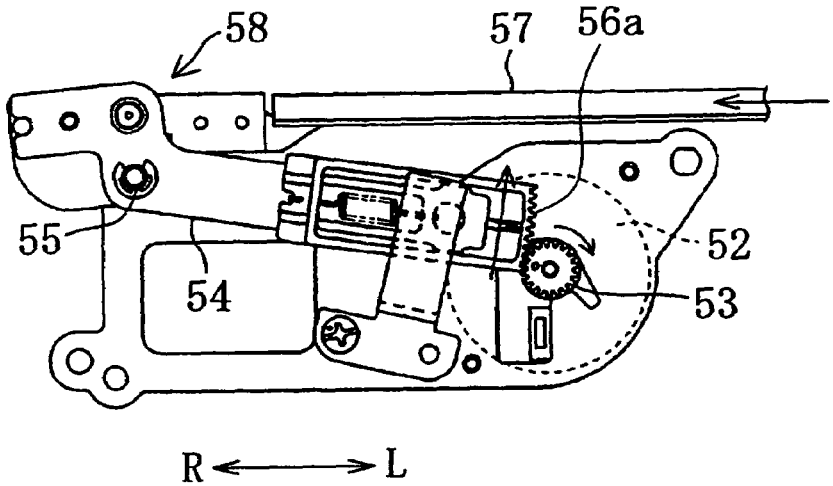
FIG. 13A corresponds to FIG. 11 with the feed dog in the rightmost position.
Figure 13B:
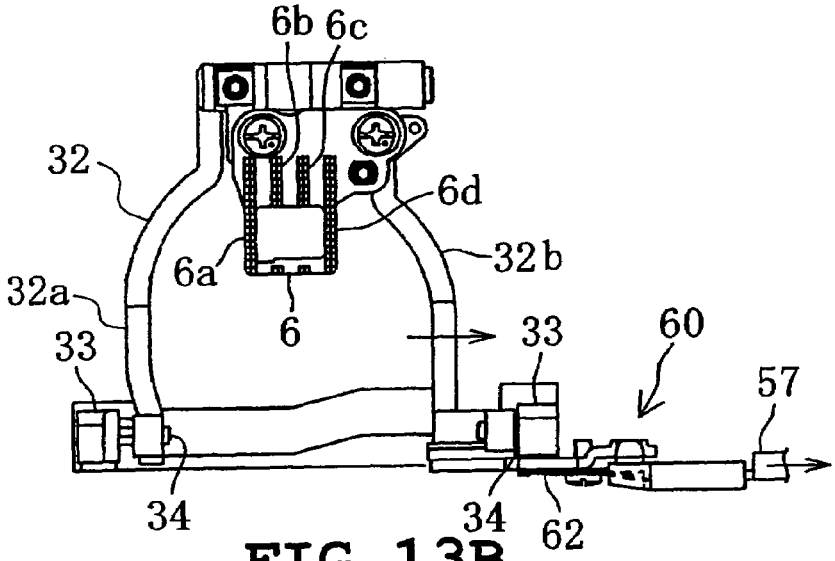
FIG. 13B is a plan view of the feed base with the feed dog in the rightmost position.
Figure 13C:
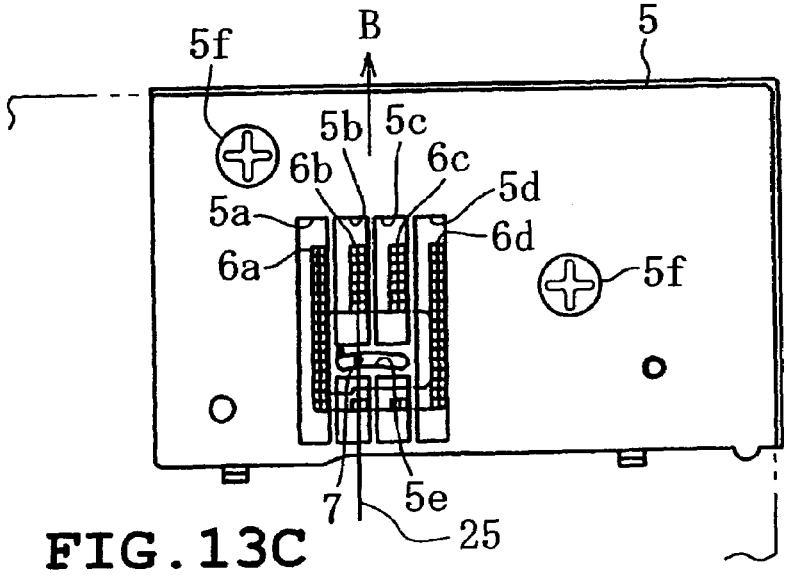
FIG. 13C is a plan view of the needle plate portion with the feed dog in the rightmost position.

As shown in FIGS. 11, 12A, and 13A, a swing lever 54 substantially in a crank form is disposed in the rear surface of the frame 51. A lower corner of the swing lever 54 is rotatably supported by the upper right portion of the frame 51 by a pin 55. A gear member 56 equipped with a sector gear 56*a* in mesh engagement with the drive gear 53 is attached on the left end of the swing lever 54. Thus, the rotation of the lateral transfer motor 52 is conveyed to the sector gear 56*a* via the drive gear 53, and the swing lever 54 is rotated about the pin 55.

Also, a laterally extending operation lever 57 is disposed on the upper side of the frame 51. The right end of the operation lever 57 is connected to an upper corner of the swing lever 54 via a first connection mechanism 58, while the left end thereof is connected to a right side leg 32*b* of the feed base 32 via a second connection mechanism 60.

The first connection mechanism 58 is constituted as a free joint comprising a tapered recess 54*a* formed on the upper corner of the swing lever 54 and a spherical member 57*a* fixed to the right end of the operation lever 57 and contained in the recess 54*a*. Also, the first connection mechanism 58 is equipped with a plate spring member 59 biased so as to prevent the spherical member 57*a* from being removed from the recess 54*a*.

The second connection mechanism 60 is constituted as a free joint comprising a connection plate 61 provided on the front end of the right side leg 32*b* and formed with a tapered recess 61*a;* and a spherical member 57*b* fixed to the left end of the operation lever 57 and contained in the recess 61*a*. Also, the second connection mechanism 60 is equipped with a plate spring member 62 biased so as to prevent the spherical member 57*b* from being removed from the recess 61*a*. Therefore, the movement of the feed base 32 in the longitudinal and the lateral direction by the cloth feed mechanism 26 is enabled by providing the first and second connection mechanisms 58 and 60 on both ends of the operation lever 57 of the feed base 32.

Thus, when the lateral transfer motor 52 is rotated counterclockwise in rear view (refer to FIG. 12A), the swing lever 54 is rotated clockwise about the pin 55. The rotation of the sewing lever 54 is conveyed to the feed base 32 via the first connection mechanism 58, the operation lever 57 and the second connection mechanism 60, and the feed dog 6 is moved to the left (refer to FIG. 12B). At this time, first to fourth teeth 6*a* to 6*d*, are moved to the left side of the corresponding square holes 5*a* to 5*d* respectively (refer to FIG. 12C).

As shown in FIG. 13A, when the lateral transfer motor 52 is rotated clockwise in rear view, the swing lever 54 is rotated counterclockwise about the pin 55. The rotation of the swing lever 54 is conveyed to the feed base 32 via the first connection mechanism 58, the operation lever 57, and the second connection mechanism 60, and the feed dog 6 is moved to the right (refer to FIG. 13B). At this time, first to fourth teeth 6*a* to 6*d*, are moved to the right side of corresponding square holes 5*a* to 5*d* respectively (refer to FIG. 13C).

The feed dog 6 is arranged to be moved by the feed dog lateral transfer mechanism 50 in a span of approximately 1.6 mm at maximum. The lateral width of the first to fourth teeth 6*a* to 6*d* is set at approximately 1.4 mm. That is, when the feed dog 6 is moved from the leftmost position (refer to FIG. 12C) to the rightmost position (refer to FIG. 13C), the distance from the left ends of the first to fourth teeth 6*a* to 6*d* in the leftmost position to the right ends of the first to fourth teeth 6*a* to 6*d* in the rightmost position is approximately 3.0 mm. This distance equals the lateral width of each square hole 5*a* to 5*d*. On the other hand, the relation between the feed dog 6 and the needle drop point is as follows. The second tooth 6*b* is associated with the needle drop points that fall within the span of approximately 3.5 mm ranging from left baseline position 7*a* to the mid baseline position 7*c*. The third tooth 6*c* is associated with the needle drop points that fall within the span of approximately 3.5 mm ranging from the mid baseline position 7*c* to the right baseline position 7*b*.

Figure 14:
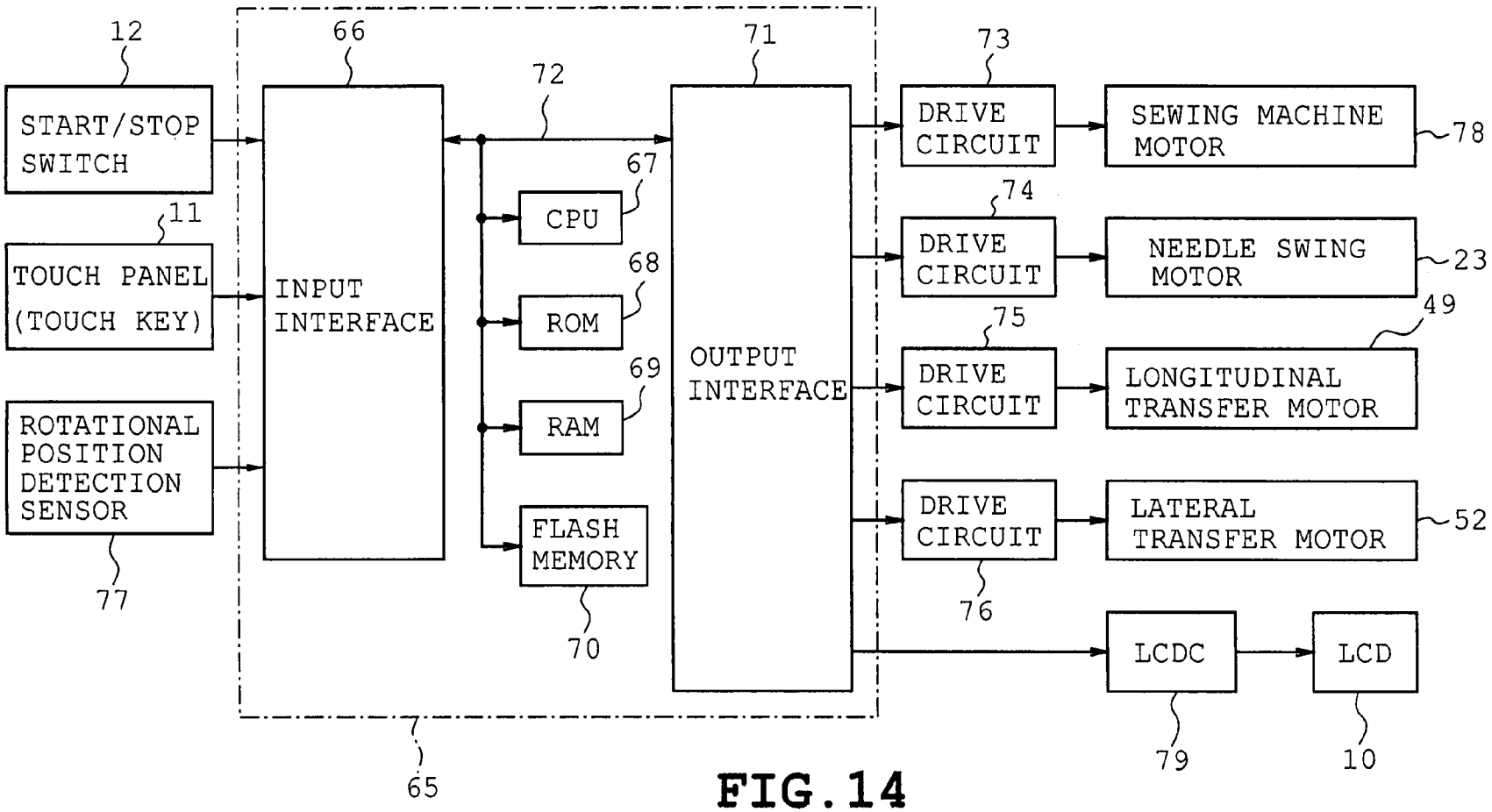
FIG. 14 is a block diagram indicating a configuration of a control system of the zigzag sewing machine.

Next, the configuration of a control system of the electronic zigzag sewing machine 9 will be described with reference to a block diagram in FIG. 14.

A control device 65 of the zigzag sewing machine 9 is configured mainly by a microcomputer including therein a CPU 67, ROM 68, RAM 69, electrically-rewritable nonvolatile flash memory 70, bus 72 such as a data bus that connects the foregoing, input interface 66, and an output interface 71, and the like.

A start/stop switch 12, touch panel 11, rotational position detection sensor 77 that detects the rotational position of the sewing machine main shaft at every small predetermined angle, and the like are connected to the input interface 66.

Connected to the output interface 71 are drive circuits 73, 74, 75 and 76 for the sewing machine motor 78, the needle swing motor 23, the longitudinal transfer motor 49, and the lateral transfer motor 52 respectively, and a display controller (LCDC) 79, or the like for a liquid crystal display (LCD).

The RAM 69 contains a pattern number memory that stores the selected stitch pattern number; various memories, pointers, counters, and the like for storing calculation results of the CPU 67 on required basis. Various preset parameters and sewing conditions, and the like, are stored in the flash memory 70.

The ROM 68 stores a control program for driving the feed dog mechanism 26, a pattern selection control program for selecting a desired stitch from plurality types of utility stitches and decorative stitches, a display control program for displaying various images on the liquid crystal display 10, a feed dog lateral transfer control program which will be described in detail hereinafter, and the like. Furthermore, a needle drop point position/feed dog position mapping table shown in FIG. 15 is stored in the ROM 68.

The needle drop point position/feed dog position mapping table stores the distance of each sewing needle 7 drop point position from the left baseline position 7*a* and the corresponding feed dog 6 movement distance from the leftmost position. For example, as can be observed from FIG. 15, in case the needle drop point falls within the range from the left baseline position 7*a* to "3 mm", the corresponding feed dog 6 movement distance is set within the range from the leftmost position to "1.6 mm" at maximum. In such case, the second tooth 6*b* intersects a longitudinally extending vertical plane 25 (refer to FIG. 20) that includes the needle drop point. In case the needle drop point falls within the range from "4 mm" to the right baseline position 7*b*, the corresponding feed dog 6 movement distance is set within the range from the leftmost position to "1.6 mm" at maximum. In such case, the third tooth 6*c* intersects the longitudinally extending vertical plane 25 (refer to FIG. 21) that includes the needle drop point.

Figure 16:
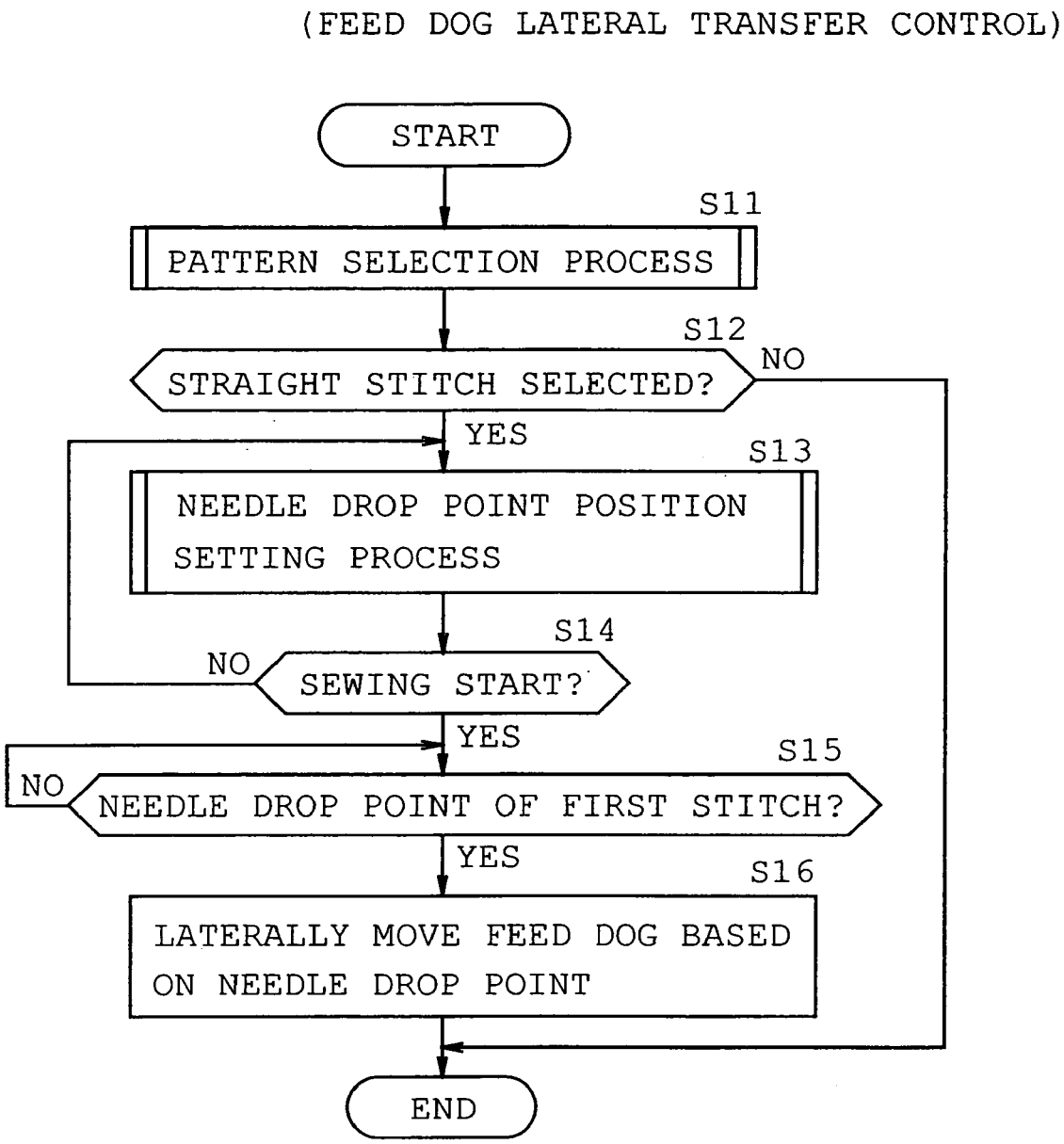
FIG. 16 is a flow chart of a feed dog lateral transfer routine.
Figure 17:
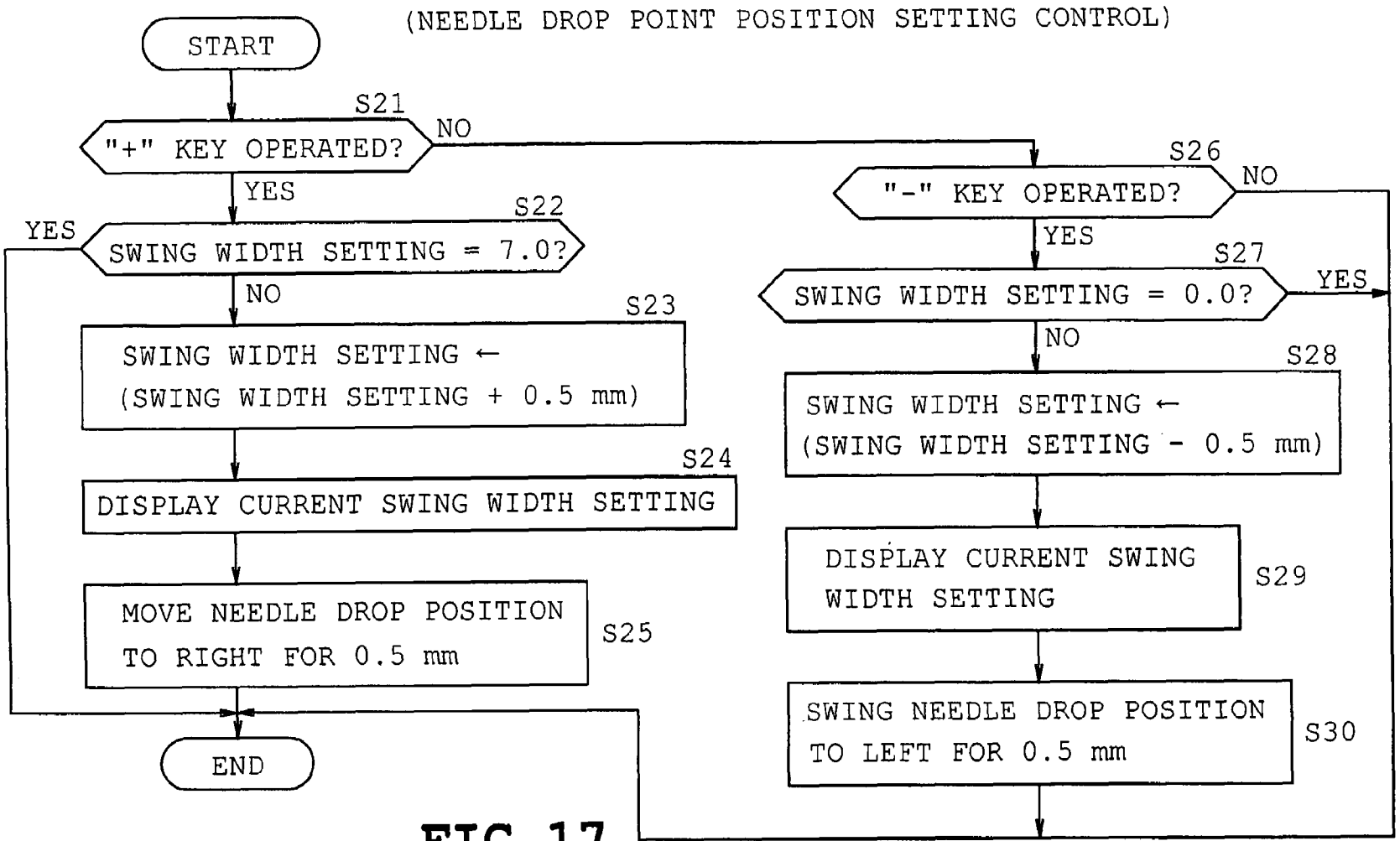
FIG. 17 is a flow chart of a needle drop point position setting routine.
Figure 18:
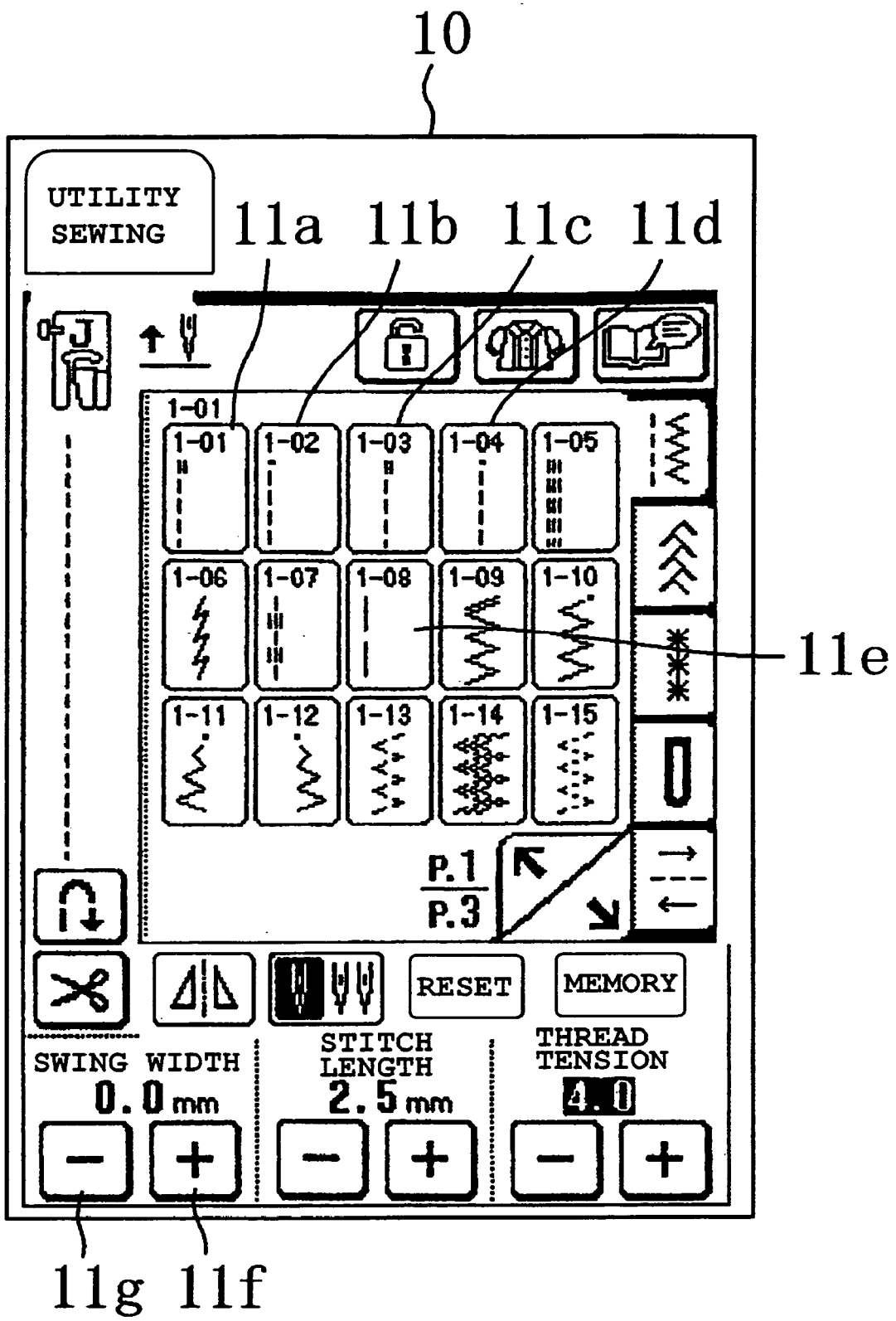
FIG. 18 is a display example of a pattern selection screen of a liquid crystal display.
Figure 19:
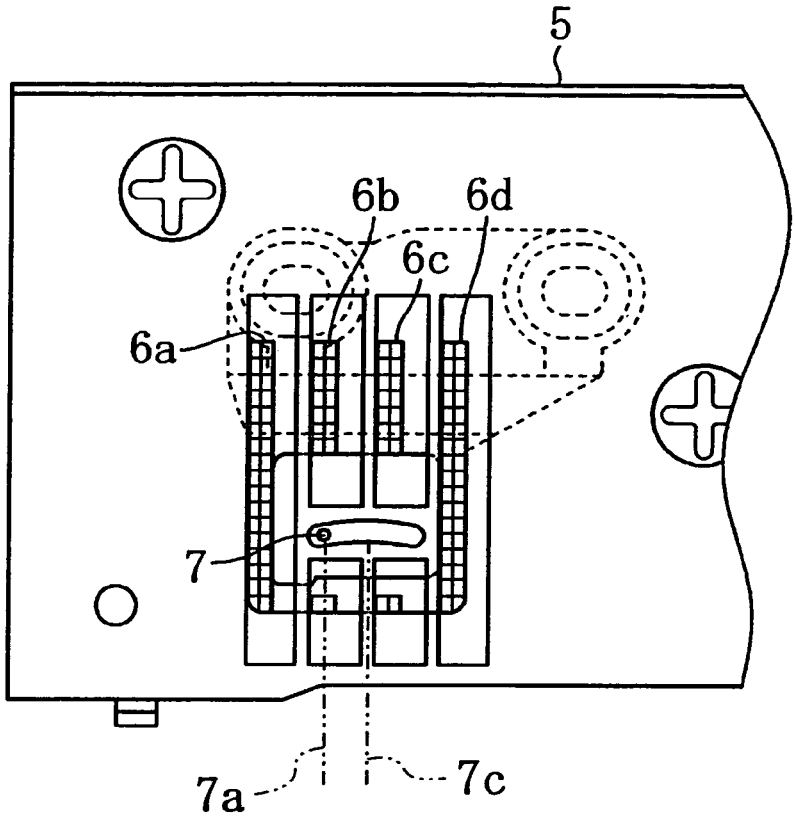
FIG. 19 is a plan view of the needle plate portion when the needle drop point position is 0.0 mm.
Figure 20:
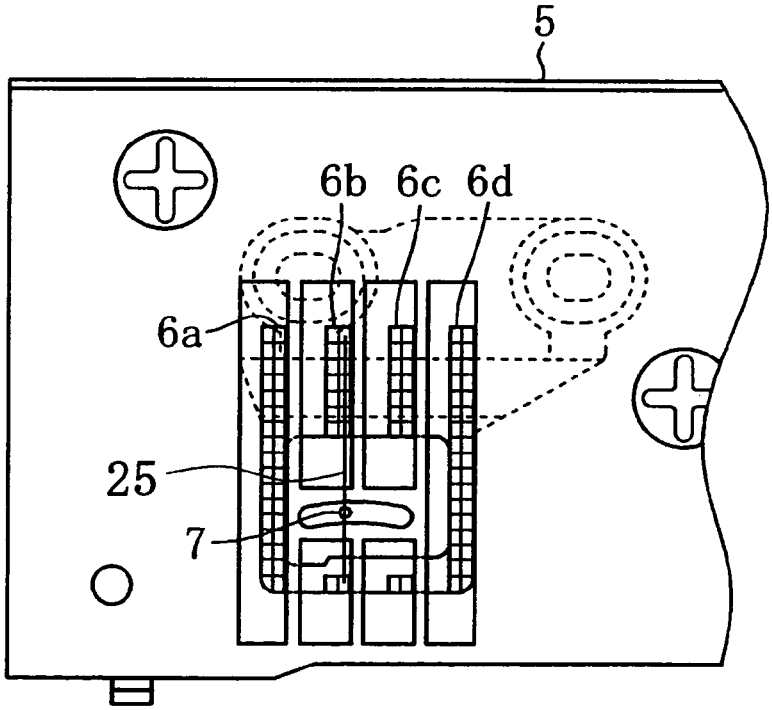
FIG. 20 corresponds to FIG. 19 when the needle drop point position is 3.0 mm.

Subsequently, the feed dog lateral transfer control program executed by the control device 65 will be described with reference to FIG. 16. FIG. 16 indicates a routine flow chart of the feed dog lateral transfer control program. The reference characters Si (i=11, 12, 13 . . . ) identify each step of the routine. The control is started by operating a touch key 10 labeled with a function name "feed dog lateral transfer" on the liquid crystal display. First, the control device 65 executes the pattern selection process (S11). As exemplified in FIG. 18, different types of utility stitches are displayed in the liquid crystal display 10 and a pattern is selected by operating the "utility stitch pattern" touch keys 11*a*, 11*b*, and the like.

In the pattern selection process, if a straight stitch is not selected (S12: No), the control device 65 terminates the process. If a straight stitch is selected (S12: Yes), the control device 65 executes the setting control (refer to FIG. 17) of a needle drop point position setting process for adjusting the position of the needle drop point (S13).

In this control, the sewing needle 7 drop point position is set to the intended position by operating a "+" key 11*f* or a "−" key 11*g* associated with "swing width" on the liquid crystal display 10. The control is started whenever the "+" key 11*f* or the "−" key 11*g* is operated. When the "+" key 11*f* is operated (S21: Yes) and the swing width value is maximized to "7.0 mm" (S22: Yes), the control device 65 terminates the needle drop point position setting control. If a swing width value smaller than the maximum value is set (S22: No), the control device 65 increments the swing width setting by "0.5 mm" (S23). The incremented value overwrites the setting and is displayed to the liquid crystal display 10 as the current swing width setting (S24) Subsequently, the control device 65 swings (moves) the sewing needle 7 drop point position to the right by "0.5 mm" (S25) and terminates the needle drop point position setting control.

When the "−" key 11*g* is operated (S21: No, S26: Yes) and the swing width value is minimized to "0.0 mm" (S27: Yes), the control device 65 terminates the needle drop point position setting control. If a swing width setting greater than the minimum value is set (S27: No), the control device 65 decrements the swing width setting by "0.5 mm" (S28). The decremented value overwrites the setting and is displayed to the liquid crystal display 10 as the current swing width setting (S29). Subsequently, the control device 65 swings (moves) the sewing needle 7 drop point position to the left by "0.5 mm" (S30) and terminates the needle drop point position setting control.

Thereafter, in the feed dog lateral transfer control, when sewing is started (S14: Yes) by pressing the start/stop switch 12, the control device 65 identifies the needle drop of the first stitch based on a sensor signal outputted from the rotational position detection sensor 77. More specifically, when the sewing needle 7 is lowered from the uppermost position to the first stitch needle drop point, that is, when it is determined that the feed dog 6 is lowered below the needle plate 5 (S15: Yes), the control device 65 laterally moves the feed dog 6 (S16) based on the position of the needle drop point and terminates the feed dog lateral transfer control. In S16, the lateral transfer motor 52 is driven based on the swing width setting specified in S24 or S29 and the needle drop point position/feed dog position mapping table in FIG. 15. Then, either the second tooth 6*b* or the third tooth 6*c* is moved to intersect the aforementioned vertical plane 25.

Next, the operation and effect of the electronic zigzag sewing machine 9 having the above construction will be described hereinafter.

When the sewing needle 7 drop point position is set at the "left baseline position" in which the swing width setting is "0.0 mm", the feed dog 6 is moved to the leftmost position (refer to FIG. 19), that is, to the "0.0 mm" position based on the aforementioned needle drop point position/feed dog position mapping table.

When the needle drop point position is "0.5 mm" in which the swing width setting is set at "0.5 mm", the feed dog 6 is moved rightward from the leftmost position by "0.5 mm". Similarly, as the swing width setting is incremented by "0.5 mm" and the needle drop point position is rightwardly moved up to the "3.0 mm" position near the middle baseline position 7*c*, the feed dog 6 is rightwardly moved accordingly in small amounts (0.5 mm) until finally reaching the rightmost position (refer to FIG. 20) at "1.6 mm". Thus, when the needle drop point is in the range from the "left baseline position 7*a*" to "3 mm" position, the feed dog 6 is moved such that the second tooth 6*b* intersects the vertical plane 25. Consequently, the stitch can be clamped between the second tooth 6*b* and the cloth presser.

Figure 21:
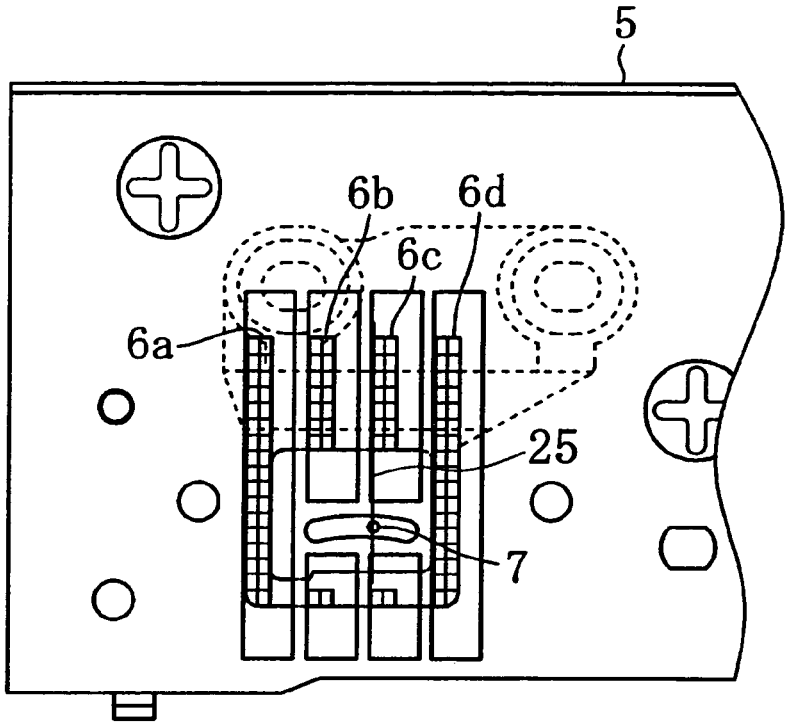
FIG. 21 corresponds to FIG. 19 when the needle drop point position is 4.0 mm.
Figure 22:
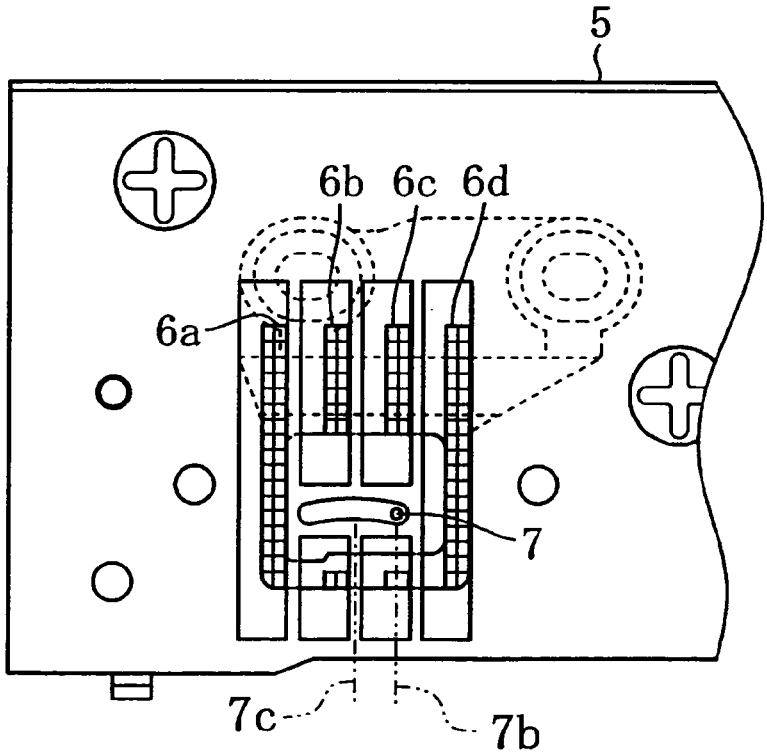
FIG. 22 corresponds to FIG. 19 when the needle drop point position is 7.0 mm.

When the swing width setting is set at "4.0 mm" and the needle drop point position is "4.0 mm" which is beyond the middle baseline position 7*c*, the feed dog 6 is moved so as to be returned to the leftmost position at "0.0 mm" (refer to FIG. 21). As described earlier, as the swing width setting is incremented by "0.5 mm" and the needle drop point position is rightwardly moved up to the right baseline position 7*b* at "7.0 mm", the feed dog 6 is rightwardly moved accordingly in small amounts (0.5 mm) until finally reaching the rightmost position (refer to FIG. 22) at "1.6 mm". Thus, when the needle drop point is in the range from the "4 mm" position to the "right baseline position 7*b*", the feed dog 6 is moved such that the third tooth 6*c* intersects the vertical plane 25. Consequently, the stitch can be clamped between the third tooth 6*c* and the cloth presser.

Since the second and third teeth 6*b* and 6*c* are moved in association with the needle drop point position of the sewing needle 7, the stitch formed on the workpiece cloth can be clamped between either the second tooth 6*b* or the third tooth 6*c* and the cloth presser. Therefore, no seam puckering is observed even if tension is applied to the needle thread by cloth feed, thereby preventing defective seams. Since the second and third teeth 6*b* and 6*c* are moved so as to intersect the longitudinally extending vertical plane 25 that includes the needle drop point, the stitch can be clamped reliably even in case the lateral widths of the second and third teeth 6*b* and 6*c* are small.

Also, the needle drop point position of the sewing needle 7 (swing width setting) can be set by the user. The control device 65 controls the needle swing mechanism 15 so that the sewing needle 7 is dropped to the specified needle drop point position and the feed dog lateral transfer mechanism 50 is controlled based on the needle drop point position. Therefore, no separate control units are required for the needle swing mechanism 15 and the feed dog lateral transfer mechanism 50, thereby providing a simple construction.

Also, since the control device 65 controls the feed dog lateral transfer mechanism 50 to move the feed dog 6 when the feed dog 6 is below the needle plate 5, the second and the third teeth 6*b* and 6*c* can be moved to the needle drop point position without laterally moving the workpiece cloth.

Also, the control device 65 controls the feed dog lateral transfer mechanism 50 from the first sewing needle 7 drop after sewing start. Thus, a high-quality stitch with no seam puckering involved can be formed from the very first stitch after sewing start.

Furthermore, the control of the feed dog lateral transfer mechanism 50 is activated only when a straight stitch is selected in the pattern selection process. Thus, while enabling the formation of straight stitches free from seam puckering, the feed dog lateral transfer mechanism 50 is reliably inactivated when forming non-straight stitches such as decorative stitches.

Next, one of a plurality of modifications of the present embodiment will be described based on FIG. 23.

Instead of controlling the feed dog lateral transfer mechanism 50 based on the needle drop point position, a needle drop point detection unit is provided that detects the needle drop point. The feed dog lateral transfer mechanism 50 is controlled based on the needle drop point position detected by the needle drop point detection unit.

Figure 23:
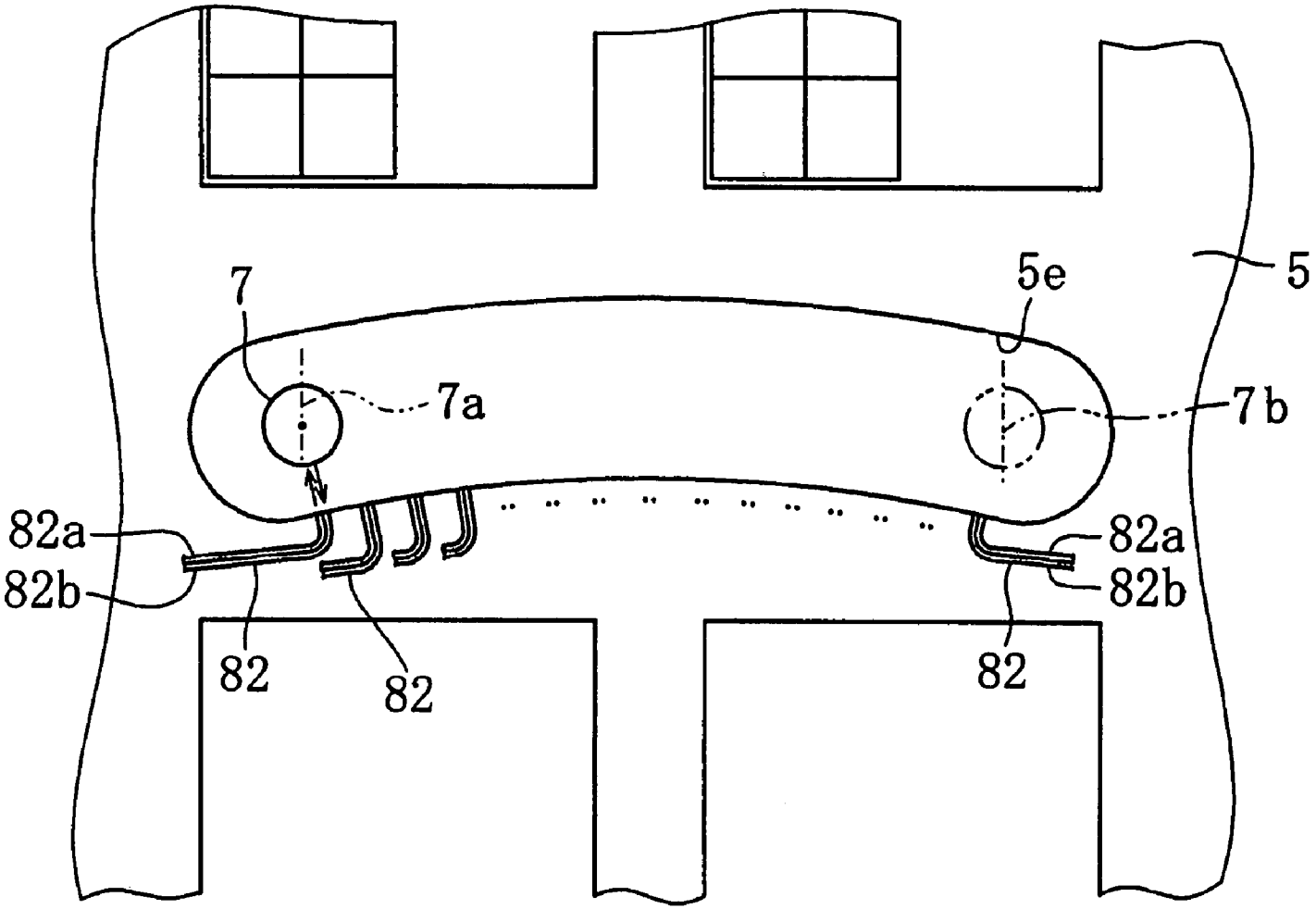
FIG. 23 is an enlarged view indicating a modified illustrated aspect of the present disclosure, in which a needle hole proximity provided with a glass fiber pair.

As shown in FIG. 23, fifteen sets of glass fiber pairs 82 are bonded in the underside of the needle plate 5 in the proximity of the needle hole 5*e*. The glass fiber pairs 82 are disposed at 0.5 mm intervals between the left baseline position 7*a* and the right baseline position 7*b* so as to correspond to each needle drop point position. The glass fiber pair 82 comprises a light emitting glass fiber 82*a* having a thickness of approximately 50 μm and a light receiving glass fiber 82*b* that are bundled together.

When the sewing needle 7 is disposed in the needle drop point corresponding to the glass fiber pair 82, the light injected from the light emitting glass fiber 82*a* reflects off the'sewing needle 7 and is received by the light receiving glass fiber 82*b*, rendering the detection of the needle drop point. The needle drop point detection unit is constructed by 15 sets of glass fiber pairs 82, or the like. Such construction provides the effect similar to the embodiment described earlier.

Modifications of the foregoing embodiments will be described hereinafter.

The teeth formed on the feed dog 6 are not limited to the first to fourth teeth 6*a* to 6*d*. A first to fifth teeth may be formed on the feed dog 6 and one of the plurality of the first to fifth teeth may be arranged to intersect the vertical plane 25.

If the electronic zigzag sewing machine is provided with a workpiece lateral feed mechanism that laterally feeds the workpiece cloth, the feed dog 6 may be controlled so as to be capable of laterally moving the workpiece cloth.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

We claim:

1. A zigzag sewing machine comprising:

a needle bar having a sewing needle attached thereto;

a needle swing mechanism that laterally swings the needle bar;

a needle plate disposed on an upper surface of a sewing machine bed;

a feed dog constituted by a plurality of teeth that feed a workpiece cloth by projecting/retracting from the needle plate;

a feed dog longitudinal transfer mechanism that longitudinally moves the feed dog;

a feed dog lateral transfer mechanism that laterally moves the feed dog; and a control unit that controls the feed dog lateral transfer mechanism so that one of the plurality of teeth is associated with a needle drop point position of the sewing needle;

wherein the control unit controls the feed dog lateral transfer mechanism based on the associated needle drop point position of the sewing needle.

2. The zigzag sewing machine according to claim 1, wherein the control unit controls the feed dog lateral transfer mechanism so that the teeth intersect a longitudinally extending vertical plane that includes the needle drop point.

3. The zigzag sewing machine according to claim 1, further comprising an input unit for setting the needle drop point position of the sewing needle, wherein the control unit controls the needle swing mechanism so that the sewing needle is dropped at the needle drop point position set by the input unit.

4. The zigzag sewing machine according to claim 3, wherein, the control unit controls the feed dog lateral transfer mechanism based on the needle drop point position set by the input unit.

5. The zigzag sewing machine according to claim 1, wherein the control unit controls the feed dog lateral transfer mechanism so as to move the feed dog when the feed dog is lowered below the needle plate.

6. The zigzag sewing machine according to claim 5, wherein the control unit controls the feed dog lateral transfer mechanism when the sewing needle is dropped for a first stitch after sewing start.

7. The zigzag sewing machine according to claim 1, further comprising a pattern selection unit for selecting a sewing pattern from plurality types of stitches, wherein a control of the feed dog lateral transfer mechanism by the control unit is activated only when a straight stitch is selected by the pattern selection unit.

8. The zigzag sewing machine according to claim 1, further comprising a needle drop point detection unit that detects the needle drop point position of the sewing needle, wherein the control unit controls the feed dog lateral transfer mechanism based on the needle drop point position detected by the needle drop point detection unit.

9. The zigzag sewing machine according to claim 2, further comprising an input unit for setting the needle drop point position of the sewing needle, wherein the control unit controls the needle swing mechanism so that the sewing needle is dropped at the needle drop point position set by the input unit.

10. The zigzag sewing machine according to claim 2, wherein the control unit controls the feed dog lateral transfer mechanism so as to move the feed dog when the feed dog is lowered below the needle plate.

11. The zigzag sewing machine according to claim 2, further comprising a pattern selection unit for selecting a sewing pattern from plurality types of stitches, wherein a control of the feed dog lateral transfer mechanism by the control unit is activated only when a straight stitch is selected by the pattern selection unit.

12. The zigzag sewing machine according to claim 2, further comprising a needle drop point detection unit that detects the needle drop point position of the sewing needle, wherein the control unit controls the feed dog lateral transfer mechanism based on the needle drop point position detected by the needle drop point detection unit.

* * * * *